US006152413A

United States Patent [19]

Gretz

[11] Patent Number: 6,152,413

[45] **Date of Patent: *Nov. 28, 2000**

[54] MOUNTING BLOCK

[75] Inventor: Thomas J. Gretz, Clarks Summit, Pa.

[73] Assignee: Arlington Industries, Inc., Scranton, Pa.

[ * ] Notice: This patent is subject to a terminal disclaimer.

[21] Appl. No.: 09/240,237

[22] Filed: Jan. 30, 1999

[51] Int. Cl.[7] ..... B42F 13/00

[52] U.S. Cl. ..... 248/343; 174/50; 174/58; 220/241

[58] Field of Search ..... 248/906, 343, 248/342, 344; 52/39; 220/241; 174/50, 58, 63, 66

[56] References Cited

U.S. PATENT DOCUMENTS 5,726,385 3/1998 Lowery et al. ..... 174/50

5,939,671 8/1999 Gretz ..... 174/50

*Primary Examiner*—Anita M. King
*Assistant Examiner*—Gwendolyn Baxter

[57] ABSTRACT

An integral electrical component mounting block comprising a central electrical box having a generally closed bottom, an open top, an interior volume and a top periphery, a planar medallion portion about the top periphery of the electrical box, the planar medallion having an outer periphery, a flange about the outer periphery extending in the direction of the electrical box to a depth about equal to that of the electrical box. The closed bottom of the electrical box includes a centrally located mounting hole, at least one means for access of power cable and a pair of slots or otherwise adjustable channels extending into the volume of the electrical box for receipt of and passage therethrough of mounting bolts for an electrical device attached through the mounting block.

6 Claims, 3 Drawing Sheets

MOUNTING BLOCK

FIELD OF THE INVENTION

The present invention relates to electrical device mounting assemblies and methods for their installation, and more particularly to a mounting assembly or block for ceiling fans, light fixtures and the like that require stable, heavy duty mounting structures.

BACKGROUND OF THE INVENTION

Mounting structures for electrical devices have met increasing demands for strength and stability with the advent and common installation of ceiling fans, particularly lighted such devices, large chandeliers and large exterior sconces. While each of these electrical fixtures or devices has its own unique set of mounting problems, ceiling fans with their large heavy motors and often the addition of lighting devices, have posed a particular issue because of the large static loads which they represent when hung from a ceiling. Additionally, the fan rotation provides a dynamic load that also requires consideration when mounting such devices.

There have been numerous efforts in the prior art to provide adequate structure for the hanging or mounting of large electrical devices that represent large static and/or dynamic loads.

U.S. Pat. No. 4,892,211 To Jorgensen describes a ceiling box for mounting and supporting a ceiling fan on a ceiling. The ceiling box includes a top wall portion with a side wall portion surrounding the periphery of the top wall portion. The box is open at the end opposite the top wall portion and the side wall portion has a pair of flanges extending normal thereto into the open end of the box. These flanges have holes in them for receiving fan-supporting screws. In a first embodiment, a pair of threaded mounting screw holes are formed in the top wall portion and are each axially aligned with an unthreaded hole that extends through the respective flange. In a second embodiment, the holes in the flanges are also threaded for added support.

U.S. Pat. No. 5,183,233 to LaPalomento, describes a support for hanging an electrical fixture from a ceiling or wall and a method for suspending the fixture. The sup [port comprises a panel that is intended to be affixed to the grid work of a house and a support affixed to the panel that holds the electrical fixture. A slot is provided on the rear of the panel to hold the panel flush against a flat surface and to allow electrical wiring to connect to the electrical fixture.

U.S. Pat. No. 5,234,119 to Jorgensen et al, describes a plastic ceiling box adapted to support a ceiling fan and designed to be mounted on a structural member, such as a ceiling joist. The ceiling box comprises a body member having a lower wall and a pair of sidewalls defining a recess for snugly receiving a ceiling joist. Box mounting holes for receiving box mounting fasteners are located at opposite sides and ends of the lower wall for attaching the ceiling box to the joist. Openings for receiving fan supporting fasteners are formed in the body member adjacent the box member and aid in attaching the body member to the joist. This overall arrangement provides sufficient support and strength to resist dynamic loads imposed by the ceiling fan even though the ceiling box is made of plastic.

U.S. Pat. No. 5,522,577 to Roesch describes a mounting assembly for supporting a ceiling fan that includes a sup [port beam located inwardly of the ceiling surface a predetermined distance. An electrical box having a bottom wall is directly joined to and supported from the support beam. The box has sidewalls extending from the bottom wall through the ceiling substantially to the exposed ceiling surface and terminating in an open end. A rigid metal plate or disk member adapted for supporting and mounting a ceiling fan is positioned over the open end of the box. The disk member is of a size sufficient to have a peripheral portion extending radially beyond the side walls of the box and a plurality of mounting screws extend from the metal disk member through the interior of the box into connected engagement with the beam. The mounting screws support the disk member from the beam without reliance on the electrical box for support.

U.S. patent application Ser. No. 08/927,614 entitled "Ceiling Medallion Assembly" filed Sep. 11, 1997 in the name of Thomas J. Gretz describes a mounting assembly for holding an electrical device in place on a joist or stud. The assembly includes an electrical box having a planar base, preferably with three planar surfaces of different depths, a fastener device for temporarily securing an electrical box in place, a ceiling medallion for covering the electrical box, a second fastener device for temporarily securing the ceiling medallion to the electrical box and a fixation device for securely fastening the electrical box and a ceiling bezel to the joist or stud. The electrical box for mounting on the joist or stud includes: a generally rectangular housing with two opposite sides having a stepped appearance defining three different depths of the housing with a third side at a first shallow depth and a fourth side at a third deepest depth, a first back piece spanning the opposing sides at a first depth approximately equal to the thickness of the ceiling material, a second back piece spanning the opposites sides of the second depth that is greater than the first depth of the first back piece, the second depth being approximately equal to twice the thickness of the ceiling material and a third back piece spanning the opposite sides at a third depth that is greater than the second depth of the second back piece.

Although the foregoing methods and apparatus have all attempted to solve the problem of adequately mounting the increased loads of electrical fixtures, none have provided a simple yet universal solution that can be used in either a new or existing installation that may or may not have or be capable of being provided with an electrical junction box proximate a joist or stud without creating a rather large and/or unsightly hole which then must be covered with an appropriate medallion or otherwise, but which poses a significant repair, if the electrical device is subsequently removed.

SUMMARY OF THE INVENTION

According to the present invention, there is provided a universal yet simple mounting block for mounting electrical devices such as ceiling fans, chandeliers, wall sconces, etc. that produce large static and/or dynamic loads. The mounting block of the present invention is easy to install, is mounted external to the mounting surface and relies on the structural members of the building to which the device is being attached to provide the strength required to carry the elevated weight and load. Additionally, no preexisting electrical box or the creation of a large hole to accommodate such an electrical box is necessary with the mounting block of the present invention.

The mounting block of the present invention is an integral component comprising a central electrical box having a generally closed bottom, an open top, and a top periphery, a planar medallion portion about the top periphery of the electrical box, the planar medallion portion having an outer periphery, a flange about the outer periphery of the medallion portion extending in the direction of the electrical box and of a depth generally equal to or slightly greater than the depth of the electrical box. The closed bottom of the electrical box includes a centrally located mounting hole, at least one knock-out for access of power cable and a pair of slots or otherwise adjustable channels extending into the volume of the electrical box for receipt of and passage therethrough of mounting bolts for the electrical device to be attached to a structural member through the mounting block. A method for the installation of an electrical device using such a mounting block is also described.

DETAILED DESCRIPTION

Figure 1:
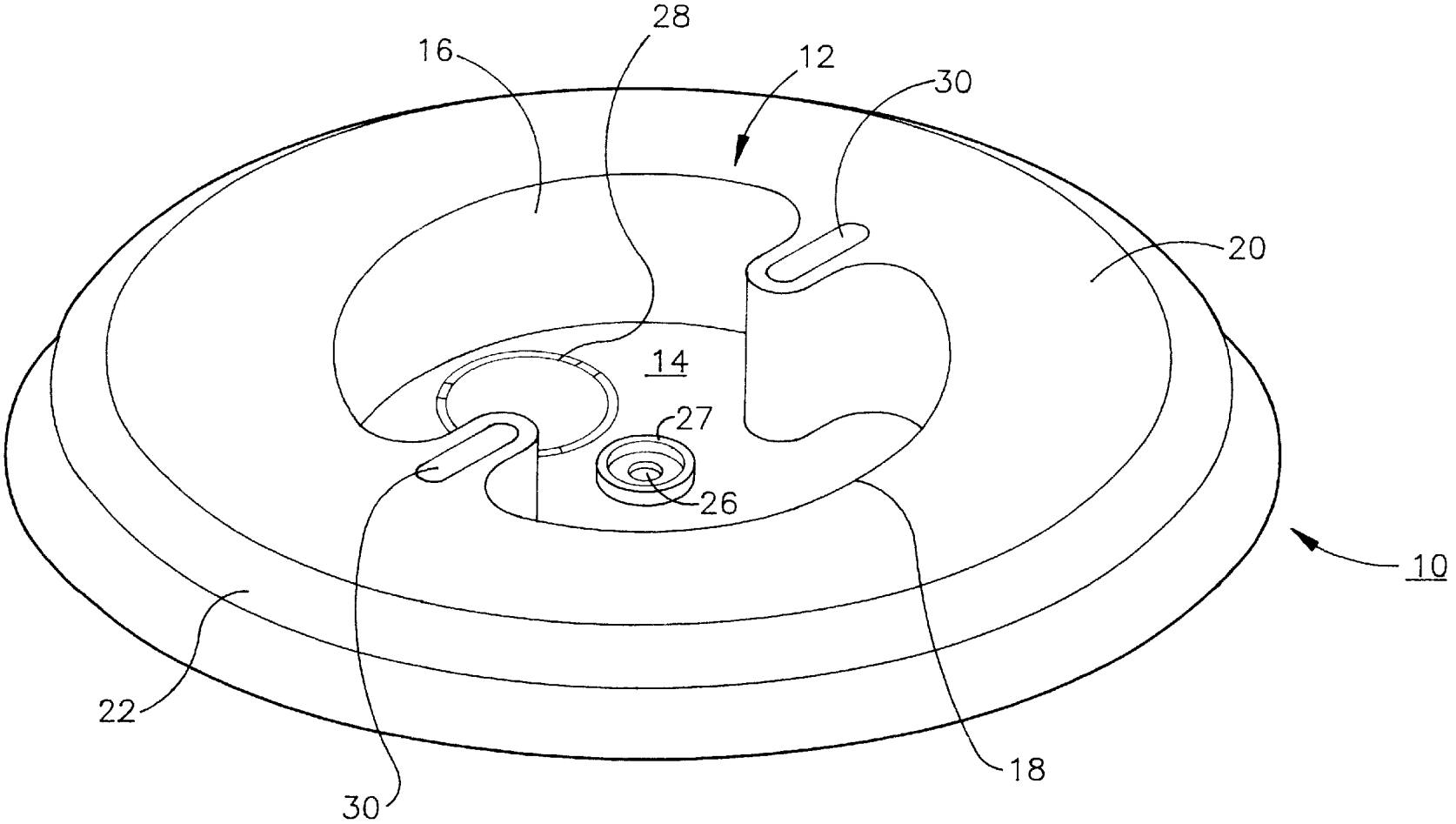
FIG. 1 is a perspective view of the mounting block of the present invention.
Figure 2:
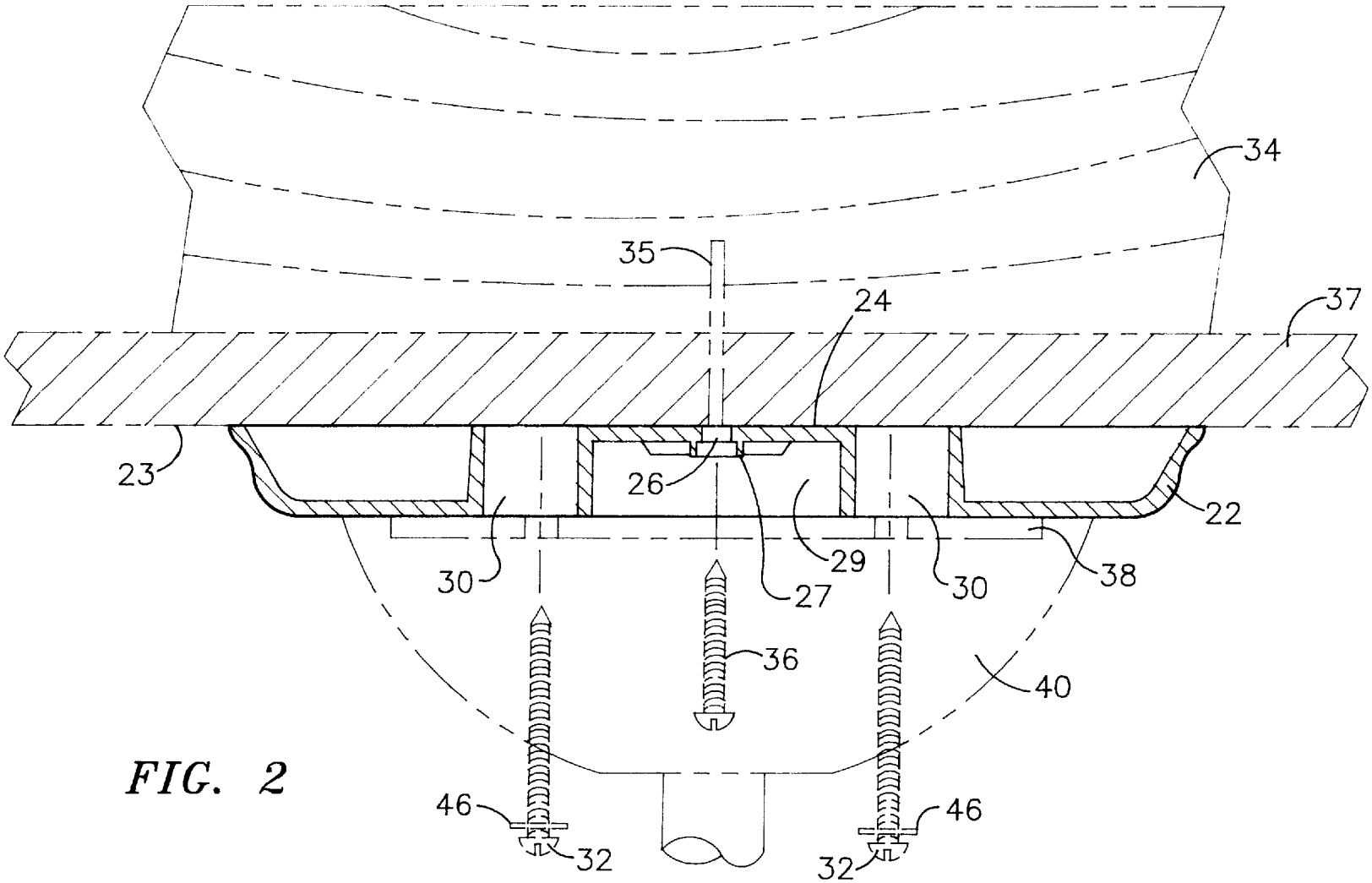
FIG. 2 is a sectional view of the mounting block of the present invention as installed.

As shown in FIG. 1, the mounting block 10 of the present invention comprises an electrical box 12 having a generally closed bottom 14, an open top 16, and a periphery 18 about open top 16. About periphery 18 and integrally formed with electrical box 12 is medallion portion 20. About the distal periphery of medallion portion 20 is a flange 22. As seen most clearly in FIG. 2, flange 22 is generally of the same depth as electrical box 12 so that when mounting block 10 is installed as described hereinafter, flange 22 and the rearmost surface 24 of electrical box 12 both contact surface 23, to which mounting block 10 is being attached, simultaneously to form a neat junction between flange 22 and surface 23. Flange 22 may extend perpendicular to planar medallion portion 20, or, as shown in FIGS. 1 and 2, be tiered or otherwise ornamental in design to provide a smoother and more aesthetically pleasing transition. Medallion 20 may of course be of any suitable diameter or shape and may be varied depending upon the size and/or shape of the base of the electrical device being installed thereover. Similarly, although electrical box 12 is shown as being round, it could be square or any other shape so long as it is covered by the base of the fixture to be installed.

Bottom 14 of electrical box 12 includes a centrally located hole 26 for attachment of mounting block 10 to a suitable structural member such as a joist or stud using a screw during installation, and at least one and preferably a pair or more of knock-outs 28 for access of appropriate cable to interior volume 29 of electrical box 12. Extending into the interior volume 29 of electrical box 12 are two slots 30 or otherwise adjustable members for receipt of electrical device mounting screws 32 as described hereinafter and shown in FIG. 2. It is preferred that slots 30 be of the same general depth as electrical box 12 and flange 22 for reasons described hereinafter. It is also preferred, as shown in FIGS. 1 and 2, that hole 26 be countersunk in bottom 14 of electrical box 12 such that hole 26 has a peripheral wall 27 that aligns an inserted screw 36 when installed as described below.

As shown in FIG. 2, installation of mounting block 10 of the present invention is accomplished by first locating a structural member 34, generally a stud or a joist, in the area where the electrical device is to be mounted, and drilling an appropriately sized hole, for example a ½" hole, 35 through ceiling or wall material 37 and into structural member 34. Whatever appropriate number of knock-outs 28 are then punched out of bottom 14 of electrical box 12 and a hole or holes of suitable size for the passage of cable through wall or ceiling material 37 drilled therein with slots 30 and hole 26 aligned with structural member 34. Mounting block 10 is then attached to structural member 34 by insertion of screw 36 or other appropriate fastener, e.g. a nail, through hole 26 in mounting block 10, appropriate cable passage hole or holes (not shown) aligned with the apertures formed by removal of knock-out(s) 28 and insertion of cable retainer 42, shown in FIG. 4, and slots 30 aligned with structural member 34 before tightening of screw 36. Since screw 36 will bear little or no weight when the installation is finalized, as described hereinafter, a #8 1½" wood screw, for example, is adequate in most cases to temporarily fasten mounting block 10 into place while installation proceeds. Electrical fixture or fan mounting bar 38 that is provided with the electrical fixture or fan 40, is then attached over mounting block 10 by insertion of appropriate larger sized screws 32 through mounting bar 38 and slots 30 so that screws 32 are securely fastened into structural member 34. Since screws 32 are going to bear the entire weight of electrical device 40 in the final installation, it is important that they be of adequate size and strength to support the static and/or dynamic load imposed by electrical device 40. In most instances, two 3"#10 wood screws will be adequate for the purpose; however, care should be taken that screws 32 are of adequate size and strength to support electrical device 40. It is preferred that lock washers 46 be installed on screws 32 to prevent loosening of screws 32, particularly in a dynamic load situation of the type encountered with ceiling fans installations. Once mounting bar 38 is properly installed, electrical device 40 is attached thereto in accordance with normal installation practice as directed by the manufacturer of electrical device 40.

Figure 4:
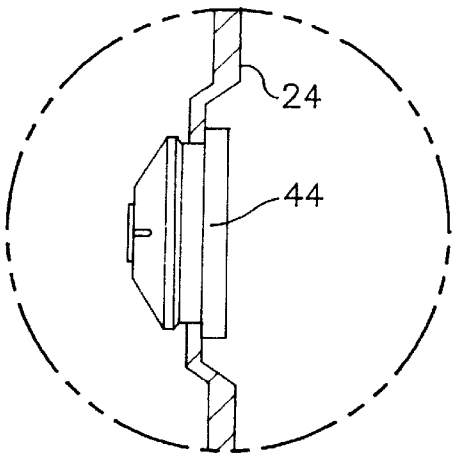
FIG. 4 is a partial cross-sectional view of the mounting block of the present invention showing a preferred cable retainer inserted into a knockout.
Figure 3:
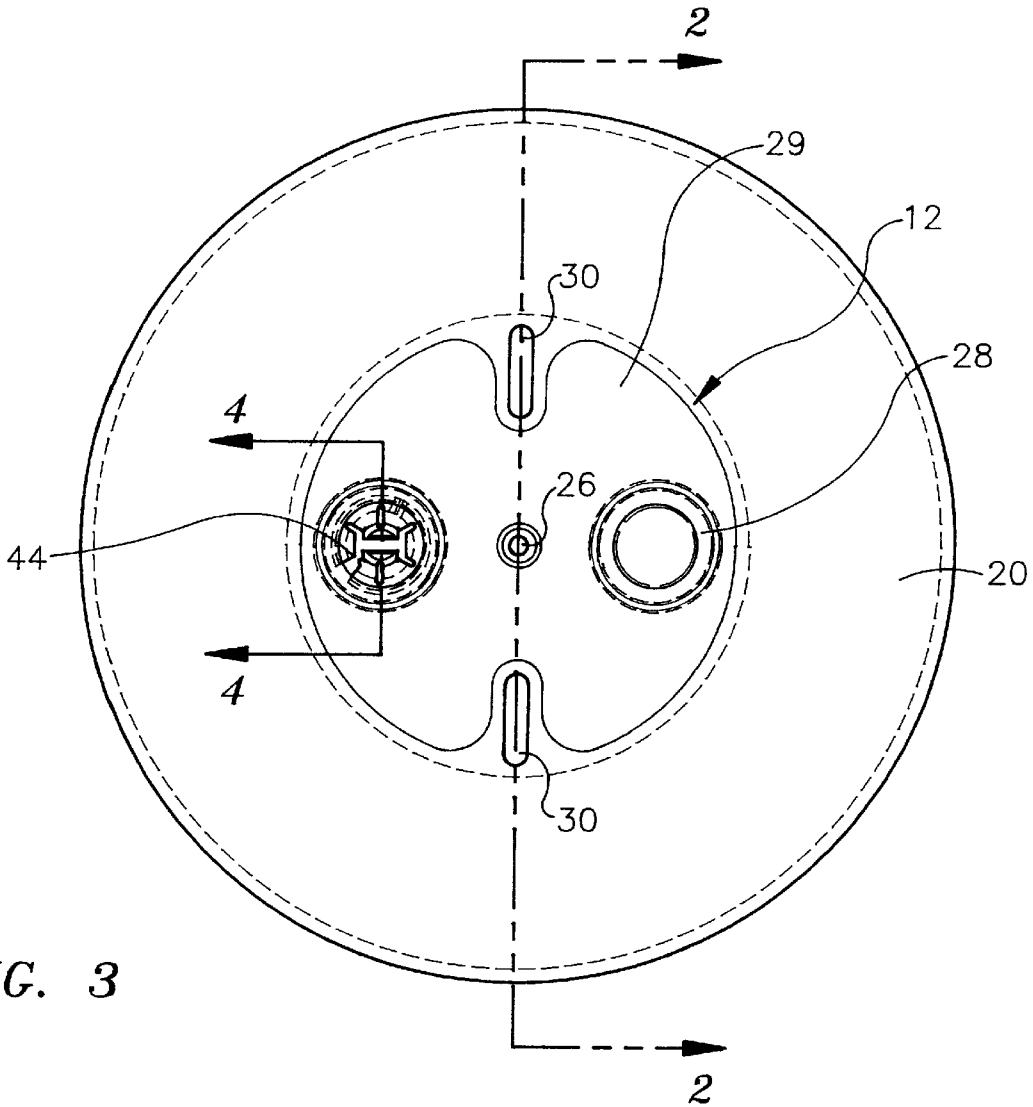
FIG. 3 is a plan view of the mounting block of the present invention.

During this stage of the installation, the necessary electrical cable(s) are secured in the apertures left by removal of knock-out(s) 28 by insertion through a cable retainer 44 of the type shown in FIG. 4 which is, in turn, inserted into the apertures left by the removal of knock-outs 28.

While slots 30 are shown in the drawings as the recipients of screws 32, it should be clear that other suitable arrangements of adjustable apertures which permit receipt of screws 32 and passage therethrough for fastening to structural member 34 are also contemplated. It is also preferred that slots 30 be of the same depth as that of electrical box 12 such that attachment of mounting bar 38 as described hereinabove with screws 32 results in an intimate and compressive and therefore rigid joining of mounting bar 38, mounting block 10, ceiling or wall material 37 and structural member 34.

In view of the integral character of mounting block of the present invention, it is preferred that it be manufactured from a plastic or polymeric material having adequate insulating characteristics. Injection molding is the preferred mode of manufacture.

From the foregoing description, one skilled in the art can easily ascertain the essential characteristics of this invention, and without departing from the spirit and scope thereof, make various changes and modifications of the invention to adapt it to various usages and conditions. It is therefor intended that the scope of the invention be limited only by the scope of the appended claims.

What is claimed is:

1. An integral mounting block for the attachment of an electrical device to a structure comprising:

a) an electrical box having a general closed bottom, an open top, a top periphery and an interior volume;

b) a planar medallion portion about the top periphery of the electrical box, said planar medallion having an outer periphery;

c) a flange about the outer periphery extending toward of the electrical box to a depth generally equal to the depth of the electrical box;

d) a centrally located mounting hole and at least one means of access through the bottom of the electrical box to the interior volume of the electrical box in the closed bottom of the electrical box; and e) a pair of opposed adjustable apertures within the interior volume of the electrical box adapted to receive mounting screws for the electrical device.

2. The mounting block of claim 1 wherein the opposed adjustable apertures comprise a pair of slots of the same depth as the depth of the electrical box.

3. The mounting block of claim 1 wherein said flange extends at right angles to said planar medallion.

4. The mounting block of claim 1 wherein said means of access through the bottom of the electrical box to the interior volume of the electrical box comprises a knockout.

5. The mounting block of claim 1 wherein said centrally located mounting hole includes a peripheral sidewall.

6. A method for attaching an electrical device mounting block the surface of a structure comprising:

locating a structural member;

providing an integral mounting block comprising a) an electrical box having a generally closed bottom, an open top, a top periphery and an interior volume;

b) a planar medallion portion about the top periphery of the electrical box, said planar medallion having an outer periphery;

c) a flange about the outer periphery extending toward the electrical box to a depth generally equal to the depth of the electrical box;

d) a centrally located mounting hole and at least one means of access through the bottom of the electrical box to the interior volume of the electrical box in the closed bottom of the electrical box; and e) a pair of opposed adjustable apertures within the interior volume of the electrical box adapted to receive mounting screws for the electrical device;

attaching said mounting block to said structural member via a fastener through said centrally located mounting hole;

aligning said pair of adjustable apertures with said structural member;

providing an electrical fixture mounting bar;

attaching said electrical device mounting bar to said structural member using a fasteners which passes through said mounting bar, said opposed adjustable apertures and into said structural member.

* * * * *